US010982905B2

(12) United States Patent
Steinbauer et al.

(10) Patent No.: US 10,982,905 B2
(45) Date of Patent: Apr. 20, 2021

(54) SEPARATING DEVICE FOR COILED HEAT EXCHANGERS FOR SEPARATING A GASEOUS PHASE FROM A LIQUID PHASE OF A TWO-PHASE MEDIUM CONVEYED ON THE JACKET SIDE

(71) Applicant: Linde Aktiengesellschaft, Munich (DE)

(72) Inventors: Manfred Steinbauer, Raisting (DE); Christian Matten, Pullach (DE); Christiane Kerber, Pocking (DE); Jurgen Spreemann, Rosenheim (DE); Ingomar Blum, Tacherting (DE); Luis Matamoros, Munich (DE); Florian Deichsel, Munich (DE); Niels Treuchtlinger, Amerang (DE)

(73) Assignee: Linde Aktiengesellschaft, Munich (DE)

( * ) Notice: Subject to any disclaimer, the term of this patent is extended or adjusted under 35 U.S.C. 154(b) by 319 days.

(21) Appl. No.: 16/085,028

(22) PCT Filed: Mar. 15, 2017

(86) PCT No.: PCT/EP2017/025050
§ 371 (c)(1),
(2) Date: Sep. 14, 2018

(87) PCT Pub. No.: WO2017/157535
PCT Pub. Date: Sep. 21, 2017

(65) Prior Publication Data

US 2019/0078842 A1 Mar. 14, 2019

(30) Foreign Application Priority Data

Mar. 16, 2016 (EP) ..... 16000628

(51) Int. Cl.
*F28B 9/08* (2006.01)
*F28D 7/02* (2006.01)

(52) U.S. Cl.
CPC ..... *F28B 9/08* (2013.01); *F28D 7/024* (2013.01)

(58) Field of Classification Search
CPC ..... B01D 53/185; F28B 9/08; F28D 7/024
(Continued)

(56) References Cited

U.S. PATENT DOCUMENTS 8,118,284 B2 * 2/2012 Alzner ..... B01D 53/185 261/97
8,517,353 B2 * 8/2013 Bannon ..... F15D 1/001 261/110

(Continued)

FOREIGN PATENT DOCUMENTS

DE 102012011329 A1 12/2013
EP 2818821 A1 12/2014

OTHER PUBLICATIONS

International Search Report dated Jul. 20, 2017 issued in corresponding PCT/EP2017/025050 application (2 pages).

(Continued)

*Primary Examiner* — Charles S Bushey
(74) *Attorney, Agent, or Firm* — Millen White Zelano & Branigan, PC; Brion P. Heaney

(57) ABSTRACT

Helically coiled heat exchanger for the indirect exchange of heat between a two-phase first medium and a second medium has a shell surrounding a shell space, which extends along a longitudinal axis, an inlet for the admission of the two-phase first medium into the shell space, a tube bundle arranged in the shell space and having multiple helically coiled tubes for accommodating the second medium and a separating device for separating a gaseous phase from a liquid phase. The separating device has a tray arranged above the tube bundle which serves for collecting the liquid phase. The tray has a plurality of chimneys for separating the two phases. Each chimney projects from the tray from a side (Continued)

of the tray facing away from the tube bundle and is covered by a roof. An opening in the tray between the roof and an upper end of the respective chimney, there is provided an inlet opening via which the gaseous phase can flow into the respective chimney.

20 Claims, 5 Drawing Sheets

(58) Field of Classification Search
USPC ..... 261/110, 152
See application file for complete search history.

(56) References Cited

U.S. PATENT DOCUMENTS

| | | | | |
|---|---|---|---|---|
| 9,004,460 | B2 * | 4/2015 | Brown | B01F 3/04078 261/110 |
| 2002/0039547 | A1 * | 4/2002 | Nelson | B01F 5/0618 422/224 |
| 2015/0000873 | A1 | 1/2015 | Steinbauer et al. | |
| 2018/0245844 | A1 * | 8/2018 | Spreemann | F28D 7/024 |

OTHER PUBLICATIONS

English Abstract of WO 2013/182268 A1 published Dec. 12, 2013 which corresponds to DE 102012011329 Al.

* cited by examiner

SEPARATING DEVICE FOR COILED HEAT EXCHANGERS FOR SEPARATING A GASEOUS PHASE FROM A LIQUID PHASE OF A TWO-PHASE MEDIUM CONVEYED ON THE JACKET SIDE

The invention relates to a helically coiled heat exchanger having

- a shell which surrounds a shell space and which extends along a longitudinal axis,
- an inlet for the admission of the two-phase first medium into the shell space,
- a tube bundle which is arranged in the shell space and which has multiple tubes for accommodating the second medium, which tubes are helically coiled about the longitudinal axis, and
- a separating device for separating a gaseous phase from a liquid phase of the two-phase first medium.

Such helically coiled heat exchangers are used for example in the case of physical scrubbers for acid gas removal (for example Rectisol processes), in ethylene plants or in plants for producing liquefied natural gas (LNG).

In typical applications of such heat exchangers, it is often necessary for a medium introduced into the shell space in two phases to be separated into a liquid phase and a gaseous phase in order that the two phases can be applied to a tube bundle of the heat exchanger separately, and in each case so as to be distributed as uniformly as possible over the shell space cross section, such that, as a consequence, an indirect exchange of heat between the two phases of the first medium and a second medium conducted in the tube bundle can take place.

Helically coiled heat exchangers having liquid distributors or separating devices for separating a gaseous phase from a liquid phase are known for example from DE 10 2012 000 146 A1, EP 2 818 821 A1, DE 10 2011 017 030 A1, DE 10 2010 055 452 A1 and DE 10 2004 040 974 A1.

In this regard, in DE 10 2012 000 146 A1, separation of the gaseous phase from the liquid phase is assisted in that the two-phase stream is applied to a correspondingly shaped impact plate. In EP 2 818 821, the two-phase stream is conducted via a core tube of the heat exchanger into a pre-distributor container and stabilized and degassed in the latter. In DE 10 2011 017 030 A1, separation of the gaseous phase from the liquid phase is effected firstly when the two-phase stream is introduced into a ring-shaped channel and secondly by way of distributor arms, which are in flow connection with the core tube for the purpose of degassing the liquid. Furthermore, the technical teaching of DE 10 2010 055 452 A1 relates to a flow-guiding device for inlet openings of downward sloping liquid channels, which allows a gaseous phase in the liquid channel to rise. Finally, DE 10 2004 040 974 A1 provides the use of an impact plate for degassing the two-phase stream.

Taking this as a starting point, the present invention is based on the object of providing a helically coiled heat exchanger having a separating device which allows, in a simple manner, improved separation of the gaseous phase from the liquid phase.

This object is achieved by a heat exchanger having a shell which surrounds a shell space and which extends along a longitudinal axis,

- an inlet for the admission of the two-phase first medium into the shell space,

- a tube bundle which is arranged in the shell space and which has multiple tubes for accommodating the second medium, which tubes are helically coiled about the longitudinal axis, and
- a separating device for separating a gaseous phase from a liquid phase of the two-phase first medium, wherein the separating device has a tray which is arranged above the tube bundle and which serves for collecting the liquid phase, wherein the tray has a plurality of chimneys for the purpose of separating the two phases, wherein the respective chimney projects from the tray from a side of the tray facing away from the tube bundle, is covered by a roof and opens into a passage opening in the tray, wherein furthermore, between the respective roof and an upper end of the respective chimney, there is provided an inlet opening via which the gaseous phase can flow into the respective chimney.

Further configurations of the invention are described below.

According to the invention, a helically coiled heat exchanger for the indirect exchange of heat between a two-phase first medium and a second medium is provided, having: a shell which surrounds a shell space and which extends along a longitudinal axis, an inlet for the admission of the two-phase first medium into the shell space, a tube bundle which is arranged in the shell space and which has multiple tubes for accommodating the second medium, which tubes are helically coiled about the longitudinal axis, and a separating device for separating a gaseous phase from a liquid phase of the two-phase first medium, wherein the separating device has a tray which is arranged above the tube bundle and which serves for collecting the liquid phase, wherein the tray has a plurality of chimneys for the purpose of separating the two phases, wherein the respective chimney projects from the tray from a side of the tray facing away from the tube bundle, is covered by a roof and opens into a passage opening in the tray, wherein furthermore, between the respective roof and an upper end of the respective chimney, there is provided an inlet opening via which the gaseous phase can flow into the respective chimney, with the result that in particular the liquid phase can flow off the respective roof past the respective inlet opening onto the tray, and with the result that the gaseous phase is able to be conducted via the inlet opening, which is situated below the respective roof, into the associated chimney and, from there, via the associated passage opening through the tray to the tube bundle.

As a result of the liquid phase being applied to the tray, a dwell time of the liquid phase which is sufficiently long and which therefore allows the gaseous phase to exit the two-phase mixture is realizable. Furthermore, the deflection of the gaseous phase on the flow path through the respective chimney results in further separation of droplets from the gaseous phase becoming possible, this further improving the separation. Moreover, it is advantageously possible to design the chimneys such that, even in the case of high liquid load, the liquid does not flow into the chimneys via the inlet openings, and, furthermore, reliable separation of the two phases is ensured.

Furthermore, it is also possible to provide on the tube side a plurality of mutually differing streams or media, in particular two or three different streams, which exchange heat indirectly with the shell-side first medium or stream. For this purpose, the tubes of the tube bundle may be divided into a corresponding number of tube groups such that one tube group is associated with each tube-side (second) medium.

According to one embodiment of the invention, the separating device may also at the same time take on the function of the actual liquid distributor. In this case, it may be provided for example that the tray has multiple openings via which the liquid phase which has been collected on the tray can rain down on the tube bundle directly, that is to say without any bypassing via further flow-guiding components.

For distributing the liquid phase, it is possible according to an alternative embodiment for a separate liquid distributor to be provided, this being in flow connection with the tray such that the liquid phase which has been collected on the tray can pass into the distributor. The distributor is configured to distribute the liquid phase over the tube bundle. For example, it is possible for the liquid phase to be conducted via an encircling gap on the shell, or via tubes, into a ring-shaped channel which is situated therebelow and which has distributor arms. Alternatively, the liquid phase can be introduced via a central opening into the core tube and subsequently conducted to a distributor in the form of a pressure distributor. Such liquid distributors are described in detail for example in DE 10 2004 040 974 A1. Other distributors are likewise conceivable.

According to a preferred embodiment comes invention it is provided that the respective chimney is formed by an encircling cylindrical wall which projects from an edge region bounding the respective passage opening, with the result that the respective passage opening of the tray forms an outlet opening of the respective chimney, which outlet opening faces the tube bundle in a downward direction.

According to a preferred embodiment of the invention, it is provided that the tubes of the tube bundle are coiled around or onto a core tube of the heat exchanger, which core tube extends in the shell space along the longitudinal axis of the shell and is preferably arranged coaxially with respect to said longitudinal axis, wherein the core tube preferably accommodates the load of the tubes. The individual tubes of the tube bundle are preferably coiled in multiple tube layers onto the core tube, wherein the individual tube layers bear on one another via spacers.

According to a preferred embodiment of the present invention, it is furthermore provided that the roof of the respective chimney has an encircling edge region with a downward pointing bottom edge which runs at the height of or below an encircling and upward pointing end side of the respective chimney, which end side bounds the inlet opening of the respective chimney.

According to a preferred embodiment of the present invention, it is furthermore provided that the chimneys each extend along an axis which runs perpendicular to the tray and in particular parallel to the longitudinal or cylinder axis of the shell of the heat exchanger, which longitudinal or cylinder axis preferably runs parallel to the vertical.

According to a preferred embodiment of the present invention, it is furthermore provided that the roof of the respective chimney projects, with the encircling edge region, beyond the associated chimney perpendicular to the axis of the respective chimney. The encircling part or edge region of the respective roof, which projects in this manner beyond the respective chimney or said cylindrical wall perpendicular to the axis of the respective chimney, is also referred to here as a protrusion of the respective roof.

According to a particularly preferred embodiment of the present invention, it is provided that in each case one inner chimney is arranged in at least one or multiple or all the chimneys (the respective chimneys are then referred to as outer chimneys), which inner chimney extends through the roof of the respective outer chimney and projects, with an upper portion, from the roof of the respective outer chimney, wherein the upper portion of the respective inner chimney has an inlet opening which is in turn covered by a roof of the respective inner chimney such that the liquid phase can flow off the roof of the respective inner chimney past the respective inlet opening of the inner chimney onto the roof of the associated outer chimney and, from there, onto the tray of the separating device, and such that the gaseous phase is additionally able to be conducted via the inlet opening of the respective inner chimney, situated below the roof of the respective inner chimney, into the respective inner chimney and, from there, to the tube bundle.

Also with regard to the inner chimneys, it is in turn preferably provided that the roof of the respective inner chimney has an encircling edge region with a downward pointing bottom edge which runs at the height of or below an encircling and upward pointing end side of the upper portion of the respective inner chimney, which end side bounds the inlet opening of the respective inner chimney.

Owing to the inner chimneys, it is possible for the separating device to be configured in a particularly structural space-saving manner. In this way, the separating device may also be arranged in portions of the shell or of the shell space, in which portions the circumference or diameter of the shell continuously decreases toward the top, with the result that a corresponding shell portion, surrounding the separating device, can assume for example the form of a frustoconical shell. Correspondingly, the shell has, according to one embodiment of the invention, a shell portion which surrounds at least one part of the separating device, in particular at least one part of the chimneys, in a cross section perpendicular to the longitudinal axis of the shell and tapers toward the top in the direction of the longitudinal axis and has, in particular, the form of a frustoconical shell.

Furthermore, according to a preferred embodiment of the invention, it is provided that the respective inner chimney extends along the axis of the in each case associated outer chimney in which the respective inner chimney is at least portionally arranged.

Furthermore, also with regard to the roof of the respective inner chimney, it is provided that said roof projects, with an encircling edge region, beyond the respective inner chimney perpendicular to the axis of the respective inner chimney, with the result that an encircling protrusion of the roof beyond the inner chimney situated therebelow is in turn formed.

According to one embodiment of the present invention, it is provided with particular preference that the respective inner chimney is arranged coaxially with respect to the in each case associated outer chimney which surrounds the inner chimney.

According to an alternative embodiment of the present invention, it is provided that the chimneys form a group of first chimneys and a group of second chimneys, wherein the second chimneys have, along their respective axis, a larger height above the tray than the first chimneys.

In this respect, according to one embodiment of the invention, it is provided that the spacing of a second chimney to the roof of an adjacent first chimney perpendicular to the axis of the second chimney is smaller than the protrusion of the roof of the adjacent first chimney.

According to a further embodiment, it is provided that the first and second chimneys are arranged alternately along the tray, such that preferably a second chimney is arranged between in each case two adjacent first chimneys or a first chimney is arranged between in each case two adjacent second chimneys.

Owing to the differing heights of the first and second chimneys and the alternating arrangement, it is thus possible to increase the number of chimneys per unit area, which improves the separation of the two phases.

Furthermore, the object according to the invention is achieved by a method for separating a gaseous phase from a liquid phase of a two-phase first medium and for exchanging heat between the first medium and a second medium through the use of a helically coiled heat exchanger according to the invention, wherein the first medium, having the liquid and the gaseous phases, is fed into the shell space via the inlet, wherein the liquid phase, when impinging on a roof during the feeding, flows off past the respective inlet opening onto the tray, and wherein the liquid phase is collected on the tray and subsequently distributed over the tube bundle, and wherein the gaseous phase is introduced via the inlet opening situated below the respective roof into the associated chimney (in particular inner chimney, outer chimney, first chimney or second chimney) and, from there, is conducted via the associated passage opening through the tray to the tube bundle.

According to one embodiment of the method according to the invention, it is provided that the chimneys are designed such that, even in the case of high liquid load, liquid does not flow into the chimneys via the inlet openings.

BRIEF DESCRIPTION OF THE DRAWINGS

Further details and advantages of the invention will be discussed by way of the following figure description of an exemplary embodiment on the basis of the figures.

In the figures:

FIG. 1 illustrates, in a schematic sectional view, the basic task of the distribution of a two-phase first medium M in a helically coiled heat exchanger 1. For this purpose, use is made according to the invention of a separating device 2 which separates a gaseous phase G from a liquid phase F of the first medium M. Thereafter, it is consequently possible for the liquid phase F and the gaseous phase G to be applied to the tube bundle 3 of the helically coiled heat exchanger 1 in each case separately and so as to be evenly distributed, which tube bundle is arranged beneath the separating device 2 and in which tube bundle a second medium M' is conducted, with the result that the two media M, M' are able to exchange heat indirectly. As already set out above, multiple medium may also be conducted separately on the tube side, which are then able to exchange heat indirectly with the first medium M.

Figure 1:
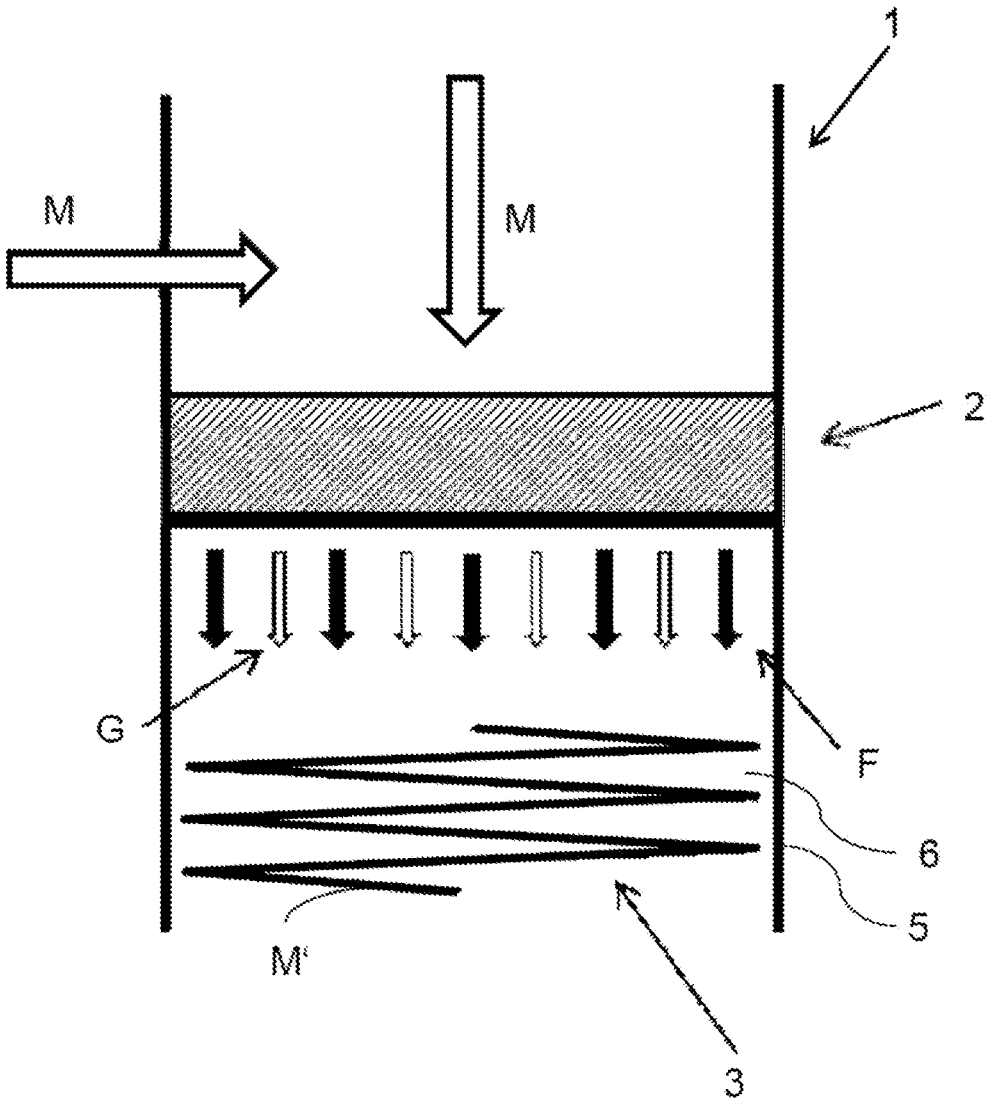
FIG. 1 shows a schematic illustration of the separation of a liquid phase from a gaseous phase of a two-phase medium to be distributed over a tube bundle.
Figure 2:
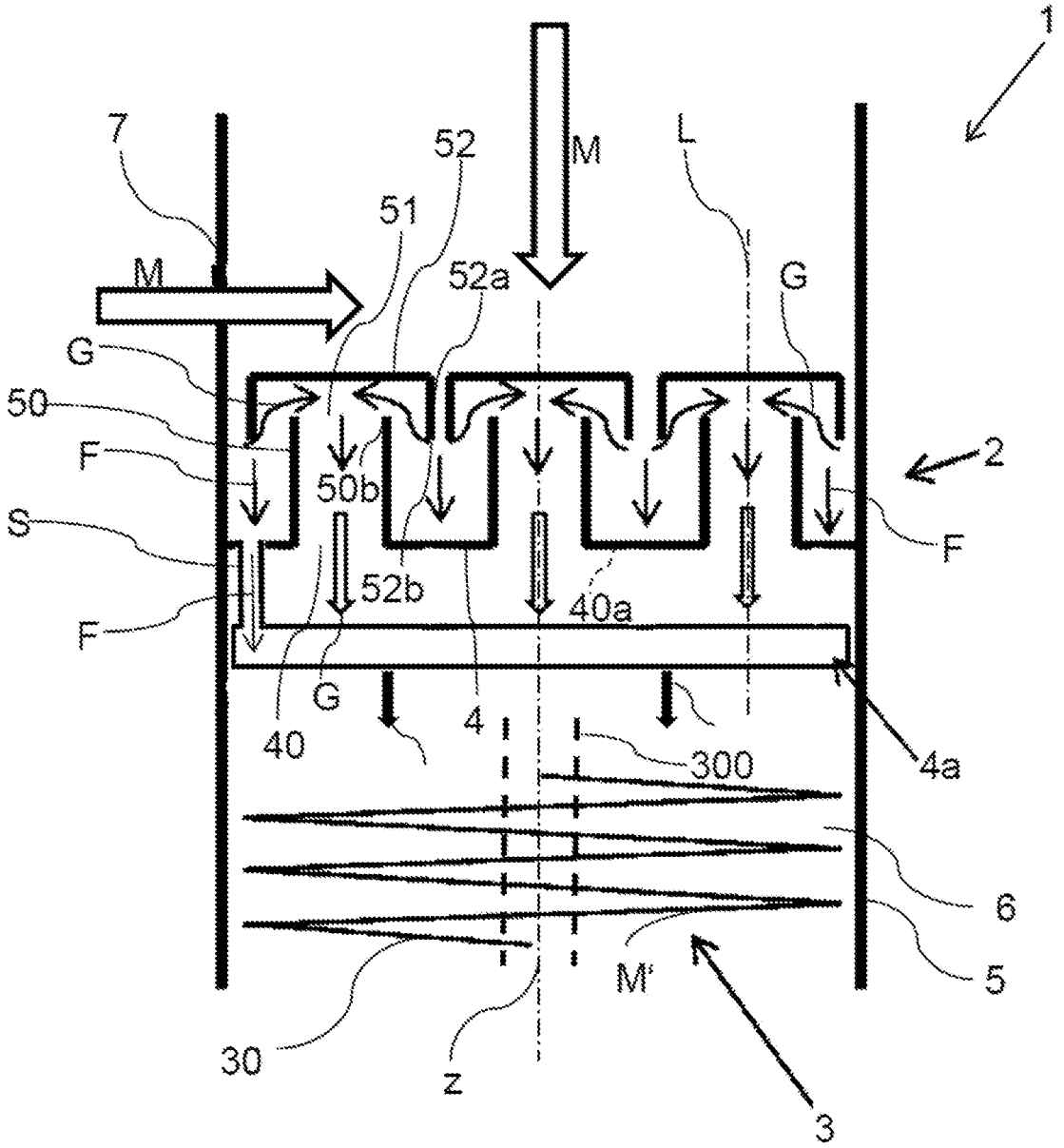
FIG. 2 shows a schematic sectional illustration of an embodiment of a helically coiled heat exchanger according to the invention.
Figure 3:
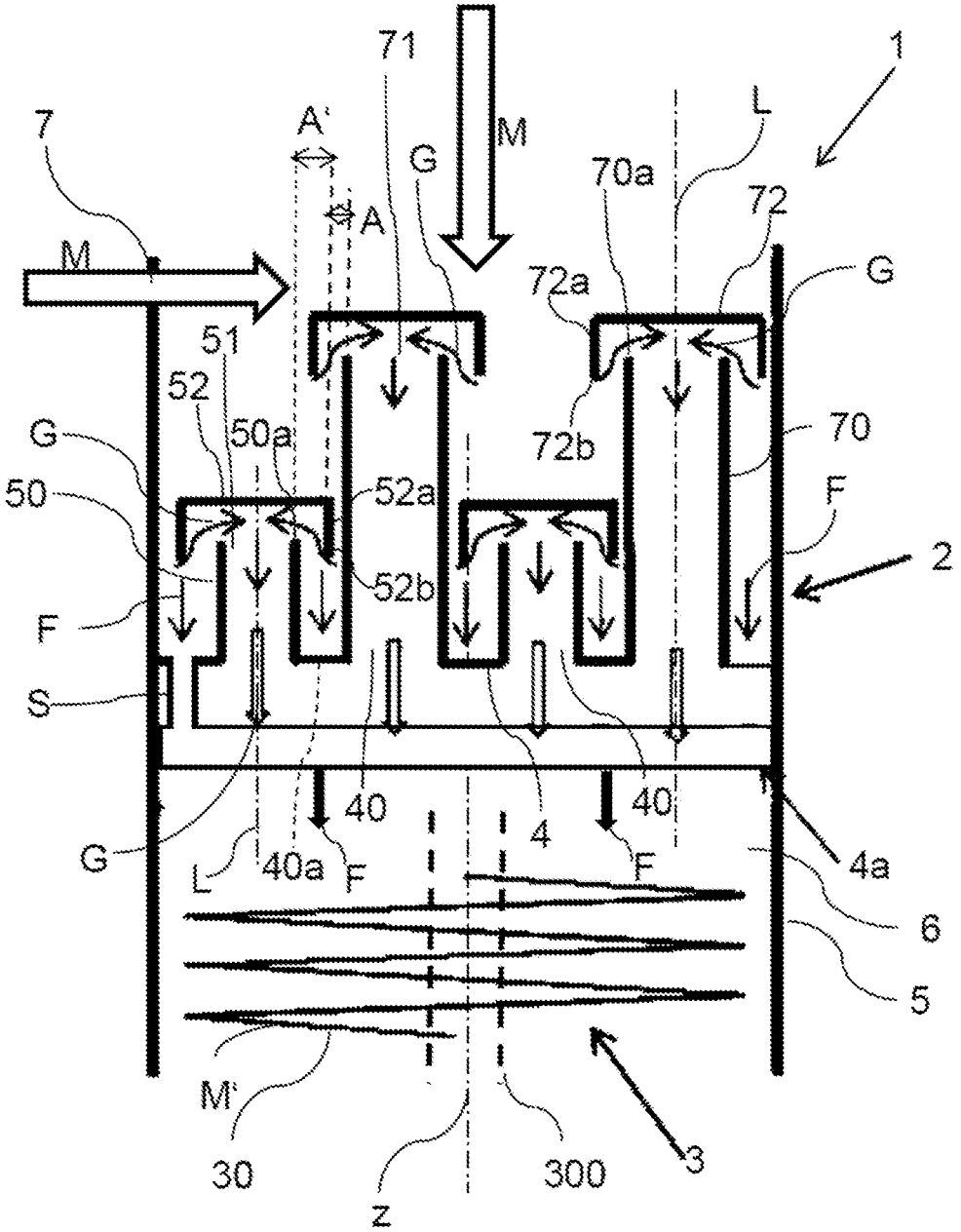
FIG. 3 shows a schematic sectional illustration of a further embodiment of a helically coiled heat exchanger according to the invention.
Figure 4:
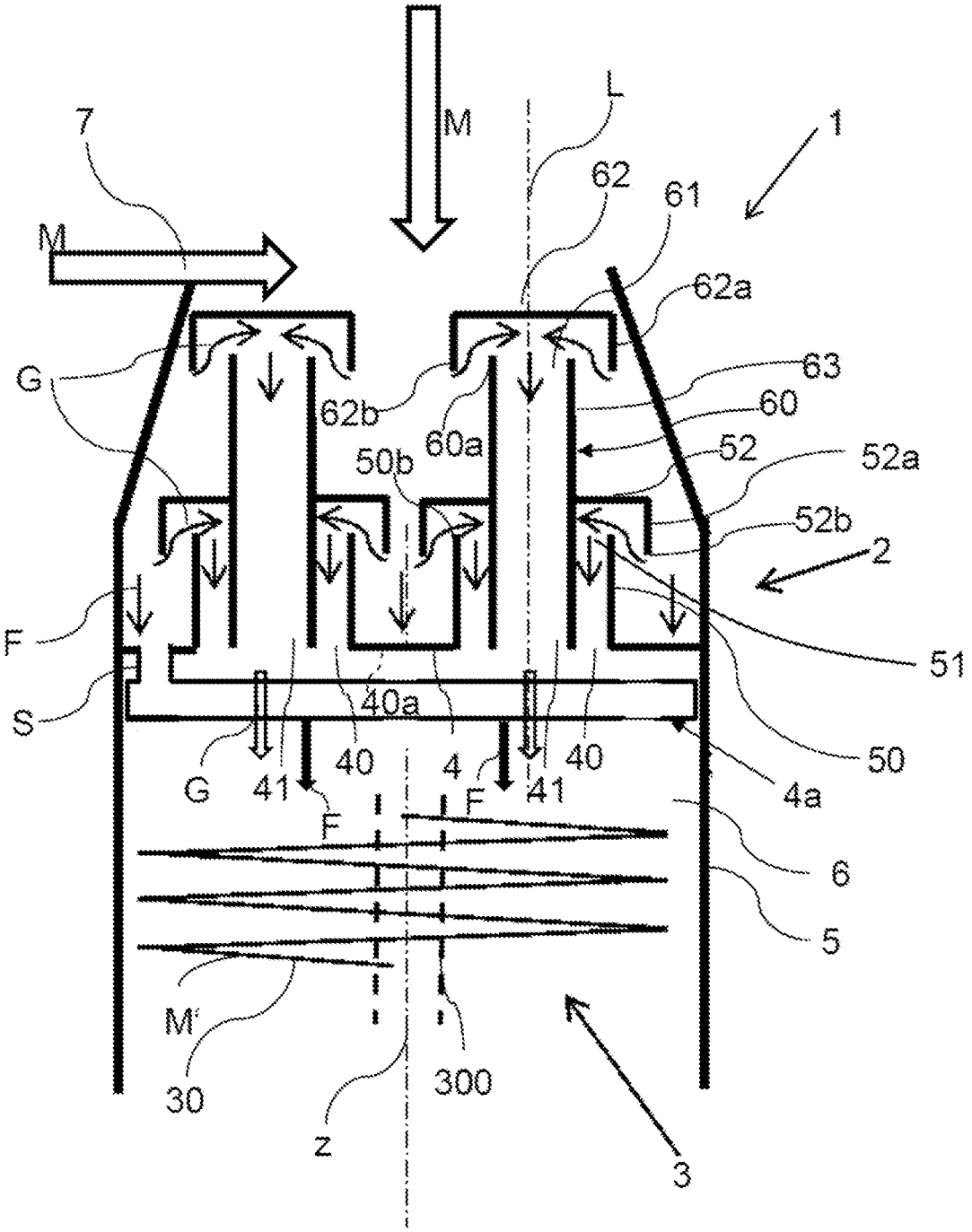
FIG. 4 shows a schematic sectional illustration of a further embodiment of a helically coiled heat exchanger according to the invention.

In the embodiments as per FIGS. 2 to 4, the helically coiled heat exchanger 1 has in each case a shell 5, which is preferably at least portionally cylindrical and which surrounds a shell space 6 of the heat exchanger 1, and a tube bundle 3, which is arranged in the shell space 6 and which may have multiple tubes 30 which may be helically coiled onto a core tube 300, wherein the core tube 300 is arranged in particular coaxially with respect to a longitudinal axis z of the heat exchanger 1 or of the shell 5, along which longitudinal axis the shell 5 extends. Said longitudinal axis z preferably runs parallel to the vertical. Furthermore, the helically coiled heat exchanger 1 as per FIGS. 2 to 4 has in each case an inlet 7 for the admission of the two-phase first medium M into the shell space 6 above a tray 4 of a separating device 2 which is configured for separating the gaseous and the liquid phases G, F of the first medium M such that the two phases F, G are able to be distributed over the tube bundle 3 separately. Here, the tray 4 runs horizontally or perpendicular to the longitudinal axis z and is arranged above the tube bundle 3, wherein said tray preferably extends over the entire cross-sectional area of the shell space 6 perpendicular to the longitudinal axis z and in this case subdivides the shell space 6 into two portions.

In all the embodiments as per FIGS. 2 to 4, the tray 4 preferably serves for collecting the liquid phase F and is preferably flow-connected to a liquid distributor 4*a* via a suitable flow connection S, wherein the liquid distributor 4*a* is configured to distribute the liquid phase F over the tube bundle 3, wherein the liquid phase F acts on the tube bundle for example from above.

Figure 5:
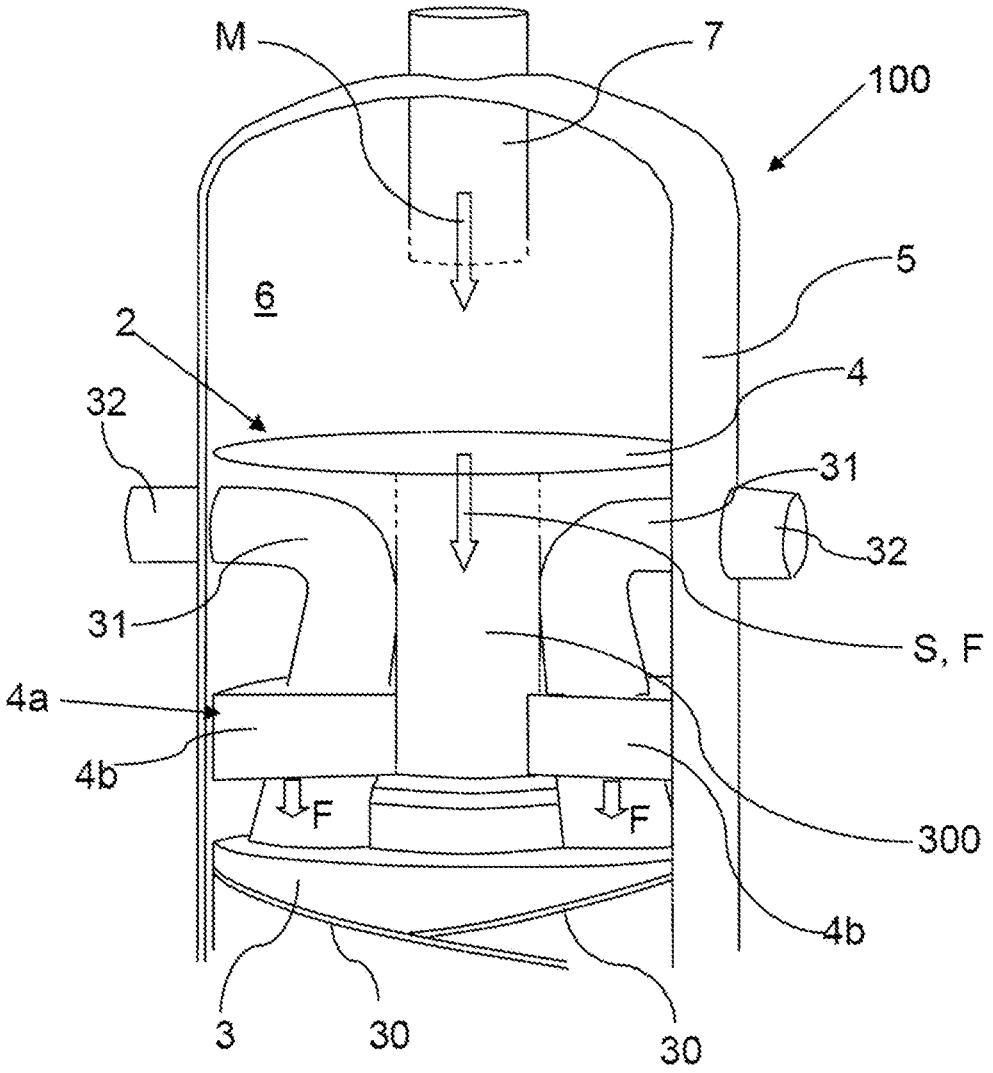
FIG. 5 shows, by way of example, a liquid distributor which may be used for distributing the liquid phase separated by a separating device according to the invention.

As liquid distributor 4*a*, use may be made of the devices already described above. Of the various possibilities, FIG. 5 shows, by way of example, an embodiment of a liquid distributor 4*a* which may be used with all the embodiments of the separating device 2 according to the invention (for example according to FIGS. 2 to 4). As per FIG. 5, the tray 4 of the separating device 2 is connected to the core tube 300 of the heat exchanger 1 by means of a suitable flow connection S such that liquid phase F which has been collected on the tray 4 can pass into the core tube 300. The chimneys 50, 60, 70 of the respective embodiment (as shown in FIGS. 2 to 4, see below) are provided on the tray 4 as per FIG. 5, wherein the chimneys are not shown here for the sake of clarity. The liquid distributor 4*a* as per FIG. 5 then has, below the tray 4*a* of the separating device 2 and above the tube bundle 3, a plurality of arms 4*b* which are in flow connection with the core tube 300 and are designed to distribute the liquid phase F over the tube bundle 3 which is arranged below the arms 4*b*. Proceeding from the core tube 300, the arms 4*b* extend in particular in each case radially outward to the shell 5, wherein, between adjacent arms 4*b*, there are provided gaps through which the tubes 30 of the tube bundle 3, gathered in so-called clusters 31, are led upward past the arms 4*b*, wherein they open for example below the tray 4 into connecting pieces 32 provided laterally on the shell 5.

As an alternative to a separate liquid distributor 4*a* (for example in the manner of FIG. 5 or as indicated in FIGS. 2 to 4), it is also possible in all the embodiments for the separating device 2 itself to function as a liquid distributor. For this purpose, the tray 4 may have a multiplicity of openings 40*a* which are distributed in particular uniformly over the tray 4 and via which the liquid phase F is then in each case applied to the tube bundle 3. A separate liquid distributor 4*a* may then be omitted.

As per the exemplary embodiment of the present invention shown in FIG. 2, the tray 4 has, for the purpose of separating the two phases F, G of the first medium M, a plurality of passage openings 40 through which the gaseous phase G is distributable over the tube bundle 3. For this purpose, the passage openings 40 are in flow connection with in each case one associated chimney 50, wherein the respective chimney 50 is preferably formed by an encircling cylindrical wall 50, which is preferably a closed wall having no apertures and projecting from an encircling edge region of the respective passage opening 40 upward in the direction of an axis L of the respective chimney 50, from a side of the tray 4 facing away from the tube bundle 3, such that the respective passage opening 40 forms a downward directed outlet opening 40, facing the tube bundle 3, of the respective chimney 50. The axes L of the chimneys 50 are preferably cylinder axes L which run parallel to the longitudinal axis z of the heat exchanger 1 or of the shell 5.

The respective chimney 50 furthermore has, at an upper end, an inlet opening 51 which is opposite the respective outlet opening 40 in the direction of the respective axis L and which, at the same time, is in each case covered by a roof 52 such that an encircling gap is formed between the respective roof 52 and the chimney 50 arranged therebelow. The liquid phase F, which is applied to the tray 4 or the separating device 2 from above, can then flow off the respective roof 52 past the respective inlet opening 51 or respective encircling gap onto the tray 4, where it is collected in order then to be distributed over the tube bundle 3 separately from the gaseous phase G, for example by means of the liquid distributor 4*a* which, more specifically, may be formed for example as per FIG. 5, while the gaseous phase G enter the associated chimney 50 via the respective gap, or the inlet opening 51 situated below the respective roof 52, and, from there, is able to be conducted via the associated passage opening or outlet opening 40 through the tray 4 to the tube bundle 3. As set out already, it is also possible to omit a liquid distributor 4*a*. In this case, the liquid phase F can be distributed over the tube bundle 3 via openings 40*a* in the tray 4.

As is furthermore shown in FIG. 2, the roofs 52 are preferably arranged at the same height in the direction of the longitudinal axis z of the helically coiled heat exchanger 1 or of the shell 5 and each have an encircling edge region 52*a* with an encircling annular bottom edge 52*b* which, in relation to the longitudinal axis z, runs at the height of or below an encircling end side 50*a* of the respective chimney 50, which end side bounds the inlet opening 51 of the respective chimney 50. In this case, it is furthermore provided that the roof 52 of the respective chimney 50 projects, with the encircling edge region 52*a*, beyond the associated chimney 50 perpendicular to the axis L of the respective chimney 50. This ensure that, where possible, no liquid fraction F of the first medium M can pass into the respective chimney 50. This furthermore results in the gaseous phase G being diverted multiple times along its flow path in the direction toward the tube bundle 3, which improves the separation of the liquid phase F from the gaseous phase G.

FIG. 3 shows a further embodiment of a helically coiled heat exchanger 1 according to the invention, in which the individual chimneys 50, 70 are basically formed in the manner of FIG. 2, wherein now, in contrast to FIG. 2, there are provided first chimneys 50 which, along the respective axis L, have a smaller height above the tray 4 than second chimneys 70. In this case, the first and second chimneys 50, 70 are arranged alternately, with the result that, owing to the different height of the respective roofs 52, 72, a larger number of chimneys 50, 70 are arrangeable on the tray 4 per unit area. This becomes clear in particular in that, with this arrangement of chimneys 50, 70 of different length, the spacing A of a second chimney 70 to the roof 52 of an adjacent first chimney 50 perpendicular to the axis L of the second chimney 70 is smaller than the protrusion A' of the roof 52 of the adjacent first chimney 50 beyond said first chimney 50. In the case of roofs 52, 72 of the same height, the spacing between two adjacent chimneys 50, 70 perpendicular to their axes L would accordingly be larger. Apart from the different length, the first and second chimneys 50, 70 are specifically formed according to the exemplary embodiment in FIG. 2.

Finally, FIG. 4 shows a further exemplary embodiment of a helically coiled heat exchanger 1 according to the invention, in which the chimneys 50 are formed in the manner of FIG. 2, wherein now, in addition, an inner chimney 60 is arranged in the respective chimney 50, formed here as an outer chimney, which inner chimney extends through the roof 52 of the respective outer chimney 50 and projects, with an upper portion 63, from the respective roof 52, wherein the upper portion 63 of the respective inner chimney 60 has an inlet opening 61 which is in turn covered by a roof 62 of the respective inner chimney 60 such that an encircling gap between the respective roof 62 and the inner chimney 60 arranged therebelow is again obtained.

It is also possible for each of the inner chimneys 60 to be formed by an encircling cylindrical wall 60 which may, in the in each case surrounding outer chimney 50, extend downward to the height of the respective passage opening 40 of the tray 4, with the result that a lower outlet opening 41 of the respective inner chimney 60, which outlet opening faces the tube bundle 3, is situated in the opening plane of the respective passage opening 40.

Correspondingly, the liquid phase F of a first medium M which is applied to the separating device 2 or the tray 4 from above can then flow off the roof 62 of the respective inner chimney 60 past the gap or the inlet opening 61 of the respective inner chimney 60 onto the roof 52 of the respectively associated outer chimney 50 and, from there, onto the tray 4, where it can be collected and further distributed over the tube bundle 3. By contrast, the gaseous phase G can further be conducted via the annular inlet openings 51 in the respective outer chimney 50 along the coaxial inner chimney 60 via the respective passage or outlet opening 40 to the tube bundle 3, wherein, owing to the inner chimneys 60, one additional flow path for the gaseous phase G is then present per outer chimney 50 since the gaseous phase G is then also able to be conducted via the inlet opening 61 of the respective inner chimney 60, situated below the roof 62 of the respective inner chimney 60, into the respective inner chimney 60 and, from there, via the outlet opening 41 of the respective inner chimney to the tube bundle 3.

As already set out further above, the roof 62 of the respective inner chimney 60 preferably also has an encircling edge region 62*a* with an annular, downward pointing bottom edge 62*b* which runs at the height of or below an encircling, upward pointing end side 60*a* of the upper portion 63 of the respective inner chimney 60, which end side bounds the inlet opening 61 of the respective inner chimney 60.

Owing to the coaxial arrangement of outer chimneys 50 and inner chimneys 60, it is, as per FIG. 4, advantageously possible for the separating device 2 to also be housed in shell portions 5*a* of the shell 5, the diameter or circumference of which shell portions continuously decreases toward the top in the direction of the longitudinal axis z.

The invention claimed is:

1. A helically coiled heat exchanger for the indirect exchange of heat between a two-phase first medium and a second medium, comprising:

a shell which surrounds a shell space and which extends along a longitudinal axis, an inlet for admission of the two-phase first medium into the shell space, a tube bundle which is arranged in the shell space and which has multiple tubes for accommodating the second medium, which tubes are helically coiled about the longitudinal axis, and a separating device for separating a gaseous phase from a liquid phase of the two-phase first medium, wherein the separating device which is arranged above the tube bundle and which serves for collecting the liquid phase, wherein the tray has a plurality of chimneys for the purpose of separating the liquid phase and the gaseous phase, wherein each chimney projects from a side of the tray facing away from the tube bundle, is covered by a respective roof, and opens into a passage opening in the tray, wherein, between each respective roof and an upper end of the respective chimney, there is provided an inlet opening via which the gaseous phase can flow into the respective chimney.

2. The helically coiled heat exchanger as claimed in claim 1, wherein the tray has, in addition to the passage openings, a plurality of openings for uniform distribution of the liquid phase over the tube bundle.

3. The helically coiled heat exchanger as claimed in claim 1, further comprising a liquid distributor below the tray for distributing the liquid phase over the tube bundle, wherein the tray is in flow connection with the liquid distributor, situated therebelow, such that the liquid phase can pass from the tray into the liquid distributor.

4. The heat exchanger as claimed in claim 1, wherein the roof of each chimney has an encircling edge region with a bottom edge which runs at the height of or below an encircling end side of the chimney, which end side bounds the inlet opening of the chimney.

5. The heat exchanger as claimed in claim 1, wherein each of the chimneys extends along a respective axis which runs perpendicular to the tray.

6. The heat exchanger as claimed in claim 4, wherein the roof of each chimney projects, with the encircling edge region, beyond the chimney perpendicular to the axis of the chimney.

7. The heat exchanger as claimed in claim 1, wherein at least one chimney is formed as an outer chimney, wherein an inner chimney is arranged in the outer chimney, and the inner chimney extends upward through the roof of the outer chimney and extends, with an upper portion, beyond the roof of the outer chimney, wherein the upper portion of the inner chimney has an inlet opening which is in turn covered by a roof of the inner chimney such that the liquid phase can flow off the roof of the inner chimney past the inlet opening of the inner chimney onto the roof of the outer chimney and, from there, onto the tray, and such that the gaseous phase is additionally able to be conducted via the inlet opening of the inner chimney, situated below the roof of the inner chimney, into the inner chimney and, from there, to the tube bundle.

8. The heat exchanger as claimed in claim 7, wherein the roof of the inner chimney has an encircling edge region with a bottom edge which runs at the height of or below an encircling end side of the upper portion of the inner chimney, which end side bounds the inlet opening of the inner chimney.

9. The heat exchanger as claimed in claim 7, wherein the outer chimney extends along a respective axis which runs perpendicular to the tray, and the inner chimney extends along the axis of the outer chimney.

10. The heat exchanger as claimed in claim 8, wherein the inner chimney extends along a respective axis which runs perpendicular to the tray, and the roof of the inner chimney projects, with the encircling edge region, beyond the inner chimney perpendicular to the axis of the inner chimney.

11. The heat exchanger as claimed in claim 7, wherein the inner chimney is arranged coaxially with respect to the outer chimney.

12. The heat exchanger as claimed in claim 5, wherein the chimneys form a group of first chimneys and a group of second chimneys, wherein the second chimneys have, along their respective axis, a larger height above the tray than the first chimneys.

13. The heat exchanger as claimed in claim 12, wherein a spacing of a second chimney to the roof of an adjacent first chimney perpendicular to the axis of the second chimney is smaller than a protrusion of the roof of the adjacent first chimney beyond said first chimney perpendicular to the axis of said first chimney.

14. The heat exchanger as claimed in claim 12, wherein the first and second chimneys are arranged alternately along the tray.

15. A method for separating a gaseous phase from a liquid phase of a two-phase first medium and for exchanging heat between the first medium and a second medium using the helically coiled heat exchanger as claimed in claim 1, said method comprising:

feeding the first medium, having the liquid and the gaseous phases into the shell space via the inlet, wherein the liquid phase, when impinging on a roof during the feeding, flows off past the inlet opening of the respective chimney onto the tray, and wherein the liquid phase is collected on the tray and subsequently distributed over the tube bundle and the gaseous phase is introduced via the inlet opening of the respective chimney, situated below the respective roof, into the respective chimney and, from there, is conducted via the associated passage opening through the tray to the tube bundle.

16. The heat exchanger as claimed in claim 12, wherein the first and second chimneys are arranged alternately along the tray such that a second chimney is in, each case, arranged between two adjacent first chimneys.

17. The heat exchanger as claimed in claim 12, wherein the first and second chimneys are arranged alternately along the tray such that a first chimney is arranged, in each case, between two adjacent second chimneys.

18. The helically coiled heat exchanger as claimed in claim 1, further comprising a core tube wherein the tubes of the tube bundle are coiled around or onto a core tube, and wherein the core tube extends in the shell space along the longitudinal axis of the shell.

19. The helically coiled heat exchanger as claimed in claim 18, further comprising a liquid distributor below the tray for distributing the liquid phase over the tube bundle below the tray, wherein the tray is in flow connection with the liquid distributor which is situated below the tray such that the liquid phase can pass from the tray into the liquid distributor.

20. The helically coiled heat exchanger as claimed in claim 19, wherein the flow connection between the tray and the liquid distributor includes the tray being connected to the core tube, such that the liquid phase which has been collected on the tray can pass into the core tube, and the liquid distributor having a plurality of arms in flow connection with the core tube which are designed to distribute the liquid phase over the tube bundle.

* * * * *